United States Patent [19]

Hagan

[11] Patent Number: 4,854,711

[45] Date of Patent: Aug. 8, 1989

[54] APPARATUS AND METHOD FOR MIXING CONCRETE

[75] Inventor: Vincent de P. Hagan, Dallas, Tex.

[73] Assignee: The Vince Hagan Company, Dallas, Tex.

[21] Appl. No.: 147,431

[22] Filed: Jan. 25, 1988

[51] Int. Cl.[4] ..... B28C 5/14; B28C 7/16

[52] U.S. Cl. ..... 366/46; 366/64

[58] Field of Search ..... 366/2, 27, 8, 16, 18, 366/30, 42, 45, 46, 64, 33, 1, 52, 53, 67, 185, 97, 98, 99, 40, 325, 327, 65, 66; 414/21; 416/224

[56] References Cited

U.S. PATENT DOCUMENTS

| | | | |
|---|---|---|---|
| 847,281 | 3/1907 | Devine | 366/46 |
| 1,693,688 | 12/1928 | Blake | 366/46 |
| 1,778,837 | 10/1930 | Schmitt | 366/46 |
| 2,138,798 | 11/1938 | Van Hooydonk | 366/185 |
| 2,155,454 | 4/1939 | Temple | 366/185 X |
| 2,165,568 | 7/1939 | Muench | 366/185 X |
| 2,929,658 | 3/1960 | Killebrew | 366/185 X |
| 3,100,064 | 8/1963 | Kacena | 366/185 X |
| 3,194,504 | 7/1965 | Entrikin | 366/327 X |
| 3,251,484 | 5/1966 | Hagan | 366/189 |
| 3,317,194 | 5/1967 | Heltzel | 366/27 |
| 3,372,910 | 3/1968 | Estis | 366/64 |
| 3,450,392 | 6/1969 | Vincent | 366/64 |
| 3,502,306 | 3/1970 | Beardsley | 366/27 |
| 3,697,054 | 10/1972 | Moratschek | 366/18 |
| 3,812,821 | 5/1974 | Laycock | 366/185 X |
| 3,872,980 | 3/1975 | Hagan | 414/21 |
| 4,194,925 | 3/1980 | Holbrook et al. | 366/40 X |
| 4,211,491 | 7/1980 | Chaney et al. | 366/46 X |
| 4,304,494 | 12/1981 | Lutz | 366/64 X |
| 4,331,069 | 5/1982 | Tomatis | 366/185 X |
| 4,416,545 | 11/1983 | Krimmel | 366/100 X |
| 4,452,536 | 6/1984 | Hinkle | 366/185 X |
| 4,506,982 | 3/1985 | Smithers et al. | 366/34 X |

FOREIGN PATENT DOCUMENTS

| | | | |
|---|---|---|---|
| 60610 | 2/1943 | Denmark | 366/64 |
| 976415 | 8/1963 | Fed. Rep. of Germany . | |

OTHER PUBLICATIONS

"Concrete Mixers–Lowest possible per-yard maintenance costs." by Besser Company, Alpena, MI, dated 1980 (month unknown).

*Primary Examiner*—Harvey C. Hornsby
*Assistant Examiner*—Scott J. Haughland
*Attorney, Agent, or Firm*—Daniel V. Thompson

[57] ABSTRACT

An apparatus and method of mixing concrete include a horizontally cylindrical mixing drum being loaded with concrete ingredients, agitating the ingredients by way of mixing elements rotating about a horizontal axis centrally located with respect to the mixing drum, rotating the mixing drum about the axis, such that an opening in the mixing drum is revolved to a horizontal elevation below the axis, and discharging the mixing drum by rotating the mixing element such that the mixing elements urge the contents thereof in the direction of and through the opening.

7 Claims, 5 Drawing Sheets

APPARATUS AND METHOD FOR MIXING CONCRETE

FIELD OF THE INVENTION

This invention relates to concrete mixing, and more particularly to a horizontal spiral blade mixer having a rotatable drum which is rotatable between loading and discharge positions.

BACKGROUND OF THE INVENTION

Large-scale construction projects involving concrete, such as roadways and dams for example, are now routinely facilitated using fully mobile concrete batching plants. Typically, a mobile batching plant includes aggregate bins, a cement silo and the required weighing and conveying apparatus all mounted to a truss configured as a semi-trailer for portability. Such mobile batching plants are described in my prior U.S. Pat. Nos. 3,872,980 and 3,251,484, the disclosures of which are incorporated by reference herein as if fully set forth.

Portable batching plants can be configured to measure and discharge the concrete ingredients into the drum of a conventional concrete transit mixer truck, with mixing being accomplished on the truck en route to the construction site. Alternatively, the batching plant can be set up s a central mix plant where a mixer at the plant receives the materials, mixes the concrete, and dumps it into conventional dump trucks for transit to the construction site.

The central mix type of operation has heretofore typically included an on-site tilting mixer. This mixer, while adequate in the general sense, suffers from a specific drawback in that a relatively long period of time is required to fill, mix and discharge this kind of mixer. Efficiency in other aspects of large-scale construction have improved to the point where the mixing operation at a central mix plant is the "bottle neck" which establishes the speed of construction. In other words, the raw material supply function and the concrete delivery function are now so efficient that mix time at the central mix plant determines the rate in cubic yards of concrete per day which can be delivered and utilized at the construction site. It is not uncommon to see a central mix plant with a line of dump trucks waiting to receive concrete at a typical central mix batching plant. Thus, there presently exists a need for a concrete mixing apparatus and method which will substantially decrease the amount of time required to load, mix and discharge batches of concrete at a central mix concrete plant.

In addition to the tilt type of mixer now in use, there are numerous other configurations of mixing apparatus that have been used in concrete mixing and/or other environments. For example, Besser Co. of Alpena, Mich. offers a central mix concrete mixer having horizontal spiral ribbons rotating in a horizontally cylindrical drum. The drum is stationary, with a discharge opening in the bottom of the drum opened and closed by a hydraulically operated trap door. The Besser prior art mixers have a typical cycle time of five minutes between batches. U.S. Pat. No. 3,812,821 to Laycock issued May 28, 1974 discloses a tilt type mixing apparatus for producing coated roadstone. U.S. Pat. No. 4,416,545 to Krimmel issued Nov. 22, 1983 discloses a mixer wherein hydraulic motors rotate spiral mixing blades within a horizontal drum and a clutch is used to couple the mixing blade shaft to the drum in order to rotate the drum between a mixing and a dumping position. U.S. Pat. No. 2,155,454 to Temple issued Apr. 25, 1939 discloses a dough mixing apparatus having a horizontally rotatable drum rotated between a mixing and a dumping position by means of a worm gear drive. U.S. Pat. No. 2,165,568 to Muench issued July 11, 1939 discloses a mixing device rotatable between a dumping and a mixing position by means of a worm gear mechanism. U.S. Pat. No. 2,929,658 to Killebrew issued Mar. 22, 1960 discloses a dumpable receptacle mounted on a vehicle for rotation about an eccentric axis by means of a hydraulic cylinder in compression. U.S. Pat. No. 3,100,064 to Kacena issued Aug. 6, 1963 shows a mortar-plaster mixer having a mixing container rotatable to a dump position about an eccentric axis by way of a hydraulic cylinder in compression. U.S. Pat. No. 4,331,069 to Tomatis issued May 25, 1982 discloses a curd making machine wherein an eccentrically mounted mixing container rotates to a dump position by way of hydraulic cylinders in compression. U.S. Pat. No. 4,452,536 to Hinkle issued June 5, 1984 discloses a cart for relatively small concrete batches having a container pivotable about an eccentric axis to a dump position by way of a hydraulic cylinder in compression. West German Patent No. 976,415 discloses a mixer having a container which ca be pivoted for discharge about an eccentric axis.

SUMMARY OF THE INVENTION

The present invention provides a portable horizontal shaft concrete mixer having a rotatable mixing drum to substantially improve the discharge speed and overcome the drawbacks of currently available mixer apparatus and methods. In a preferred embodiment, a mixing apparatus includes a semi-trailer having a horizontal mixer support platform from which two spaced shaft supports extend upwardly. A horizontal shaft is rotatably mounted between bearings at the top of each shaft support and carries a plurality of arms and mixing blades for corotation with the shaft. Power means is provided for causing controlled rotation of the shaft arms and blades. A generally horizontally cylindrical mixing drum encloses the arms, blades and the intermediate portion of the shaft extending between the shaft supports. The mixing drum is coaxial with the shaft, with end portions of the shaft extending through central apertures in the end plates of the drum. The drum is supported on the mixer support platform by casters such that it is rotatable about its central axis between a loading position and a discharging position. Substantially all of the weight of the mixing drum is carried by the casters, which are fixed to the mixer support platform, and the shaft does not bear any substantial portion of the mixing drum weight. A pair of hydraulic piston and cylinder assemblies extend between the mixer support platform and the mixing drum at locations spaced from the central axis, such that activation of the piston and cylinder assemblies causes the mixing drum to rotate between positions. The hydraulic piston and cylinder assemblies are in tension when the drum is moved from the loading position to the discharge position to avoid buckling of the assemblies under their greatest load.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION OF THE PREFERRED EMBODIMENT

Figure 1A:
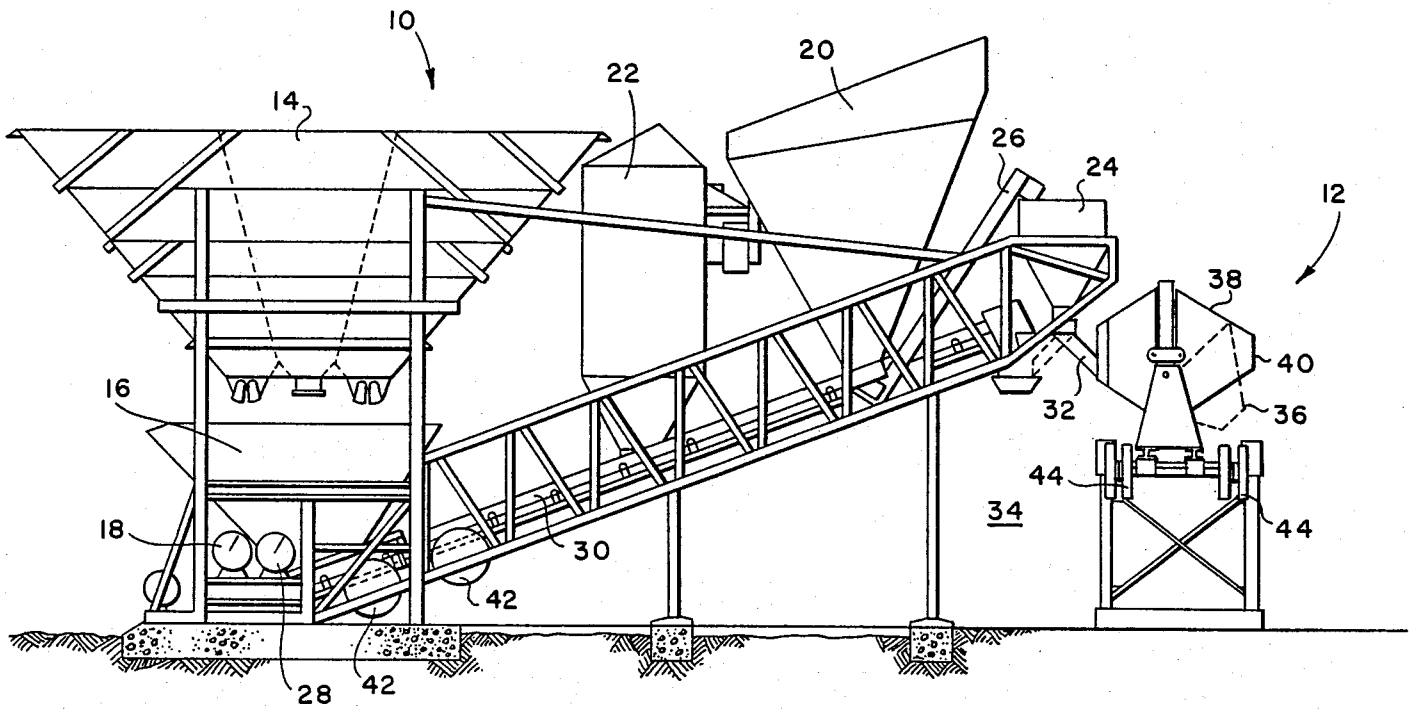
FIG. 1A PRIOR ART
FIG. 1A is a side view of a central mix concrete batching plant illustrating a prior art tilting type of mixer.

Referring initially to FIG. 1A, a prior art central mix batching plant 10 having a tilting type mixer 12 is illustrated. Plant 10 includes aggregate bin 14 and aggregate batcher 16. Scales 18 are utilized to monitor and control aggregate batching. Silo 20 holds cement. Baghouse 22 is provided to control dust emissions from the plant. A cement batcher 24 receives cement from silo 20 through cement feeder 26, and is monitored and controlled by way of scales 28. A conveyor belt 30 is provided to transport batched aggregate to discharge hood 32, which is swivellable as shown by the dotted lines in FIG. 1A between mixer 12 and a position shown in dotted lines in FIG. 1A over a space 34 through which transit mixers can drive and be loaded with concrete ingredients, if desired.

Mixer 12 in FIG. 1A is the prior art tilting type of mixer. As shown by the dotted lines 36, mixer 12 has a pivotable drum 38 which tilts downwardly such that mixed concrete may be discharged from an open end 40. Both plant 10 and mixer 12 are portable in that wheels 42 on plant 10 and wheels 44 on mixer 12 enable the equipment to be transported and then erected on location.

Figure 1B:
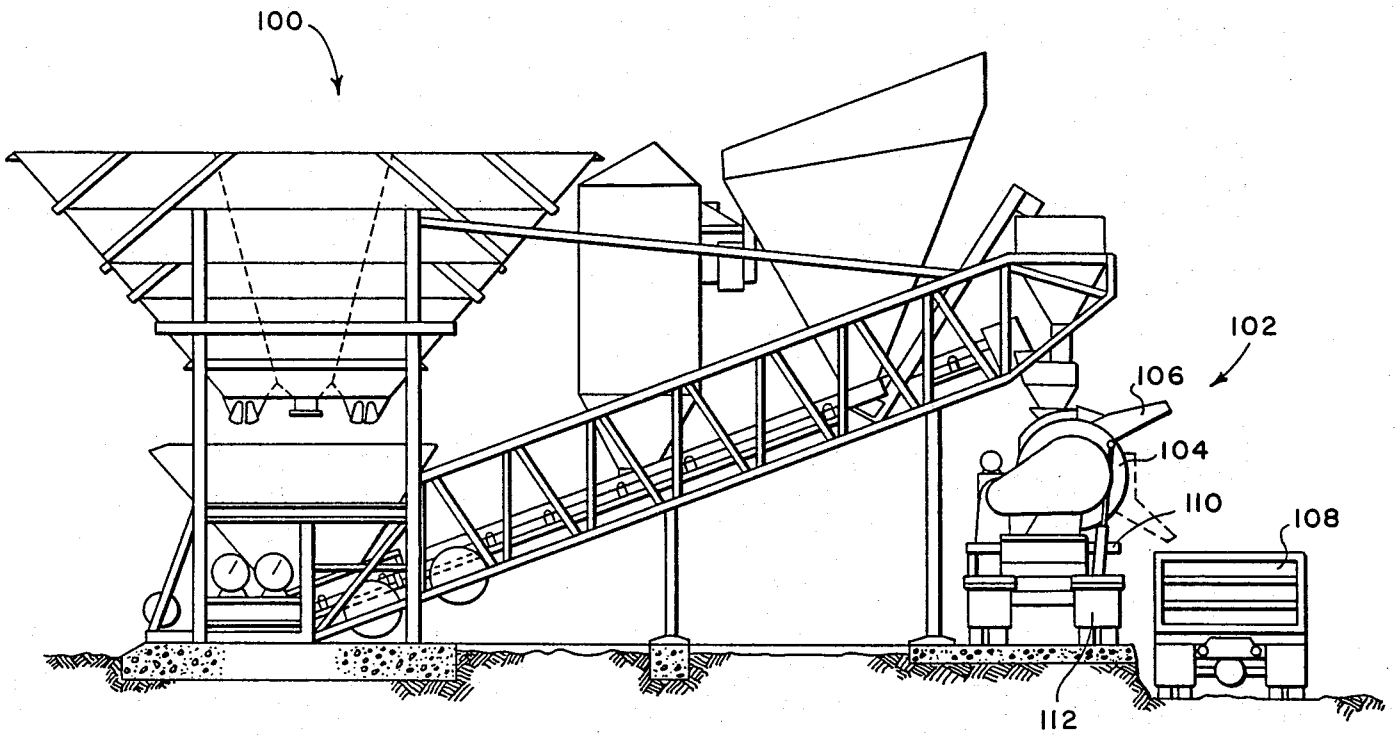
FIG. 1B is a side view of the batching plant of FIG. 1A illustrating the mixer apparatus of the present invention.
Figure 2:
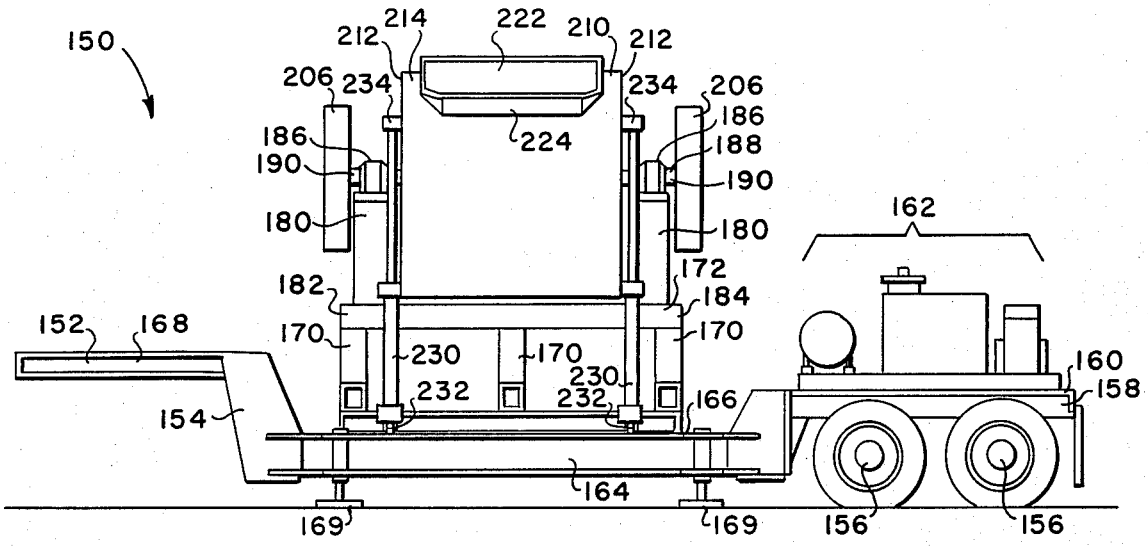
FIG. 2 is a side view of the mixer apparatus of the present invention.
Figure 4:
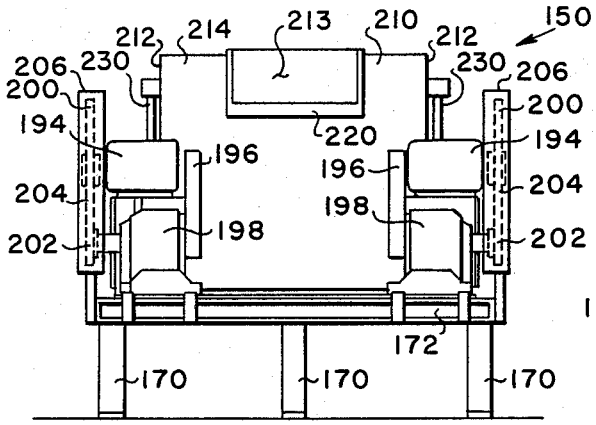
FIG. 4 is a side view of the mixer apparatus opposite to the view of FIG. 2 and omitting depiction of the semi-trailer.
Figure 5:
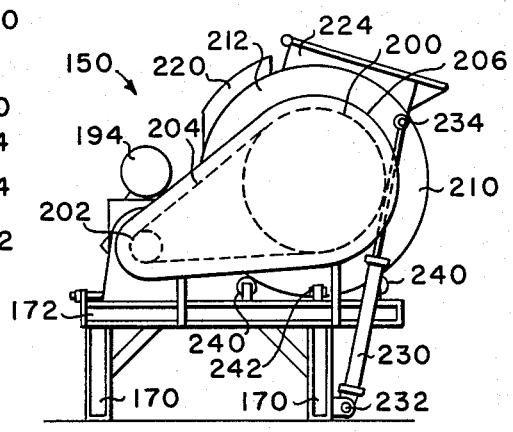
FIG. 5 is an end view of the mixer apparatus of FIG. 4.
Figure 3:
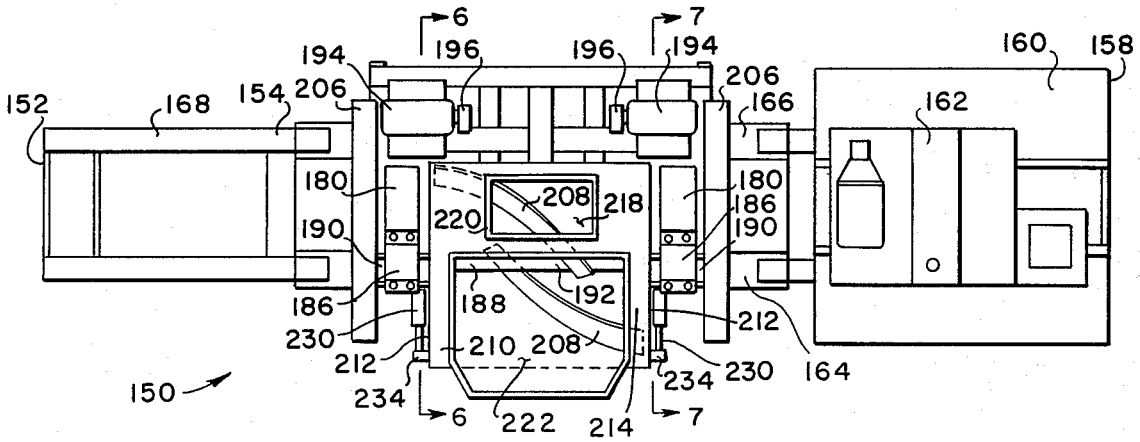
FIG. 3 is an overhead view of the mixer of FIG. 2.

Referring now to FIG. 1B, batching plant 100 is substantially identical to batching plant 10 previously described in connection with FIG. 1A. Mixer 102, however, incorporates the present invention, which enables significantly improved mixing and discharge times over the prior art mixer. Mixer 102 includes a rotatable drum 104 which rotates between a loading position shown in solid lines and a discharge position shown in dotted lines. In the discharge position, mixed concrete is rapidly discharged down chute 106 into waiting dump truck 108, which transports the mixed concrete to the construction site. Mixer 102 includes a horizontal mixer support platform 110 and a semi-trailer 112 to enable transport of the mixer apparatus.

Referring now to FIGS. 2, 3, 4 and 5, wherein like numerals indicate like and corresponding elements, mixer apparatus 150 includes a semi-trailer 152 composed of a framework 154 having support axles 156 in conventional fashion. A rear portion 158 of framework 154 defines a rear equipment platform 160 suspended over axles 156. A hydraulic power unit 162 is mounted to rear equipment platform 160, and in the preferred embodiment is rated at 40 horsepower.

A medial portion 164 of the framework adjoins the rear portion 158 and defines a medial equipment platform 166. In the preferred embodiment, medial equipment platform 166 is at a lower elevation than the rear equipment platform 160. A front portion 168 of the framework adjoins the medial portion 164 opposite the rear portion 158. The front portion defines a tongue for connection to a towing vehicle. Levelling supports 170 are provided to levellably support the medial portion 164 when the semi-trailer is disconnected from a tow vehicle.

Risers 170 extend upwardly from the medial equipment platform to form a mixer support framework attached to the medial equipment platform. A mixer support platform 172 is fixed to the top of risers 170. The height of risers 170 may be selected for desired vertical positioning of the mixer with respect to the medial support platform, taking into account the location of the discharge hood of the batching plant A pair of spaced upright members 180 extend upwardly from the front side 182 of mixer support platform 172 and the rear side 184 of mixer support platform 172. Upright members 180 form a mixer cradle for supporting the mixing mechanism hereafter described.

Each of the upright members 180 includes a large pillow block bearing 186 at the top thereof, with the bearings 186 fixed in coaxial alignment with each other. A long shaft 188 is supported by bearings 186 for rotation about an axis which is horizontal and substantially longitudinal with respect to the semi-trailer. End portions 190 extend outwardly from bearing 186, and an intermediate portion 192 extends between the bearings.

Torque is applied to shaft 188 by means of electric motors 194, which are coupled to the shaft through belts 196, gear reducers 198 and chain and sprocket mechanisms having large driven sprockets 200 coupled to end portions 190 of the shaft and small driving sprockets 202 coupled to gear reducers 198. Chains 204 couple the sprockets, and the chain and sprocket mechanisms are enclosed by chain guards 206. Motors 194 are supported by gear reducers 198, which in turn are fixed to the mixer support platform 172. In the preferred embodiment, rotative torque is applied to both end portions 190 of the shaft, but the same result can be accomplished by applying torque to only one end of the shaft, if desired In the preferred embodiment, each electric motor 194 is rated at 50 horsepower and has a rotative speed of 1750 R.P.M., and the speed of shaft 188 is reduced by the gear reducers and chain and sprocket mechanisms to 18 R.P.M.

Mixer blades 208 are fixed to intermediate portion 192 of shaft 188 for corotation with shaft 188. Blades 208 describe an envelope that is approximately cylindrical when in rotation. The weight of shaft 188 and blades 208 is substantially entirely supported by bearings 186 atop upright members 180.

A mixer drum 210 is formed by two disc-shaped end walls 212 and a tubular side wall 214. Walls 212 and 214 form a substantially cylindrical outer surface and a substantially cylindrical inner surface, with the inner surface being in close proximity to the envelope described by the rotating blades 208. In the preferred embodiment, the drum 210 is fabricated from welded steel and includes replaceable inner liners having a hardness of at least 250 Brinell to withstand the highly abrasive concrete mixing environment. End walls 212 are located relatively close to bearings 186, such that blades 208 and substantially all of the intermediate portion 192 of the shaft 188 are enclosed by drum 210.

A loading opening 218 is defined in the tubular side wall 214 of drum 210, and is centrally located with respect to the drum 210 to receive materials from the discharge hood of the batching plant when the drum is in the position shown in FIGS. 2, 3, 4 and 5. In the preferred embodiment, opening 218 is substantially rectangular and includes walls 220 about the opening. A second opening 222 is also provided in the tubular side wall 214 of drum 210 for discharging the drum. Preferably, opening 222 is centrally located with respect to drum 210 and is relatively wide in dimension as shown. Walls 224 extend outwardly from tubular member 214 about opening 222 to define a discharge hood. Opening 222 is substantially near the top of drum 210 when it is in the position shown in FIGS. 2, 3, 4 and 5.

A pair of hydraulic piston and cylinder assemblies 230 extend between drum 210 and the mixer support framework at pivotal mounts 232. At the opposite end of assemblies 230 from mounts 232, the assemblies are connected to mixer drum 210 at pivotal mounts 234. Conduit means (not shown) is interposed between assemblies 230 and hydraulic power unit 162 for extending and retracting assemblies 230 in conventional fashion.

Drum 210 is supported on mixer support platform 172 by casters 240. Substantially all of the weight of drum 210 is carried by casters 240, and the weight of mixer 210 is thereby isolated from shaft 188. An end roller 242 is provided at each end of mixer 210 and fixed to mixer support platform 172 to control side-to-side movement of mixer 210.

Figure 6A:
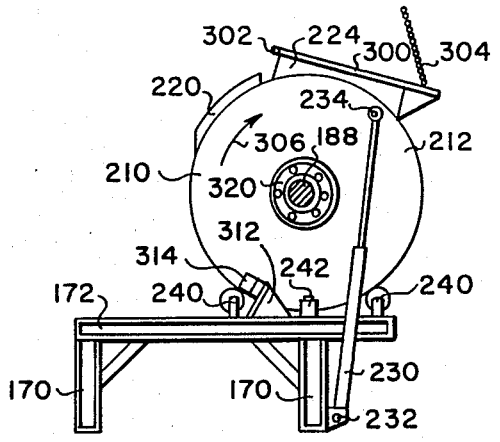
FIGS. 6A and 6B are sectional views taken along lines 6—6 of FIG. 3 and showing the mixer drum in its loading and discharging positions, respectively.
Figure 6B:
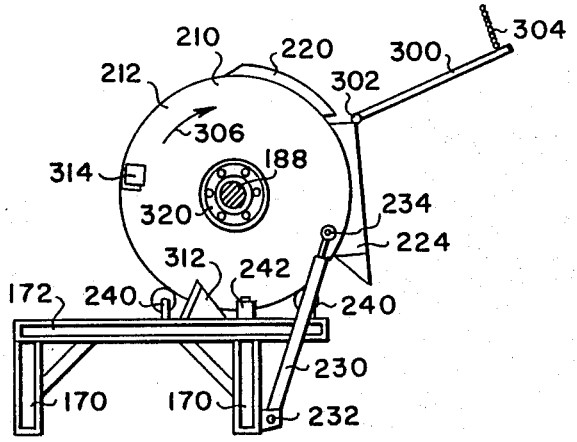

Referring now to FIGS. 6A and 6B, drum 210 is rotatable between a loading position shown in FIG. 6A and a discharge position shown in FIG. 6B. Preferably, a door 300 is hingedly connected to an edge 302 of a wall 224 to cover the discharge opening when the drum is in the loading position. A chain or cable 304 is connected to the batching plant above the mixer in order to pivot the door to the open position shown in FIG. 6B when the drum is in the discharge position. Mounts 234 are spaced radially from the central axis of mixing drum 210, such that retraction of hydraulic assemblies 230 will cause rotation of the drum in the direction of arrow 306. Conversely, extension of hydraulic assemblies 230 will cause rotation of the drum in the opposite direction. A key feature of the invention is the provision of hydraulic assemblies 230 such that rotation of the drum to the discharge position is accomplished by activating assemblies 230 in tension. In other words, rotation from the loading position to the discharge position is accomplished by retracting hydraulic assemblies 230. When mixing drum contains a full batch of concrete, the drum and its contents are extremely heavy, and substantial force is required to rotate the drum to the discharge position. It has been found that hydraulic assemblies of the required length undergo excessive buckling forces if they are used in compression to rotate the loaded mixer drum. Once the drum has been discharged, it is relatively light and the compression forces required on assemblies 230 are not excessive when rotating the drum back to the loading position shown in FIG. 6A.

A safety stop 312 is fixed to mixer support platform 172 and cooperates with a boss 314 fixed to one of the end plates 212 The activation of hydraulic assemblies 230 is electrically controlled, as will be more fully described hereafter, but stop 312 and boss 314 will prevent over-rotation of drum 212 in the event the electrical control system fails, thereby preventing over-extension of hydraulic assemblies 230.

As shown in FIGS. 6A and 6B, shaft 188 extends through central apertures in the end plates 212 of drum 210. Drum 210 is thus coaxial with shaft 188, enabling relative rotation of drum 210 about shaft 188 as shown. The interface between drum 210 and shaft 188 includes a bushing and seal assembly 320, which will be described in more detail below.

Figure 7:
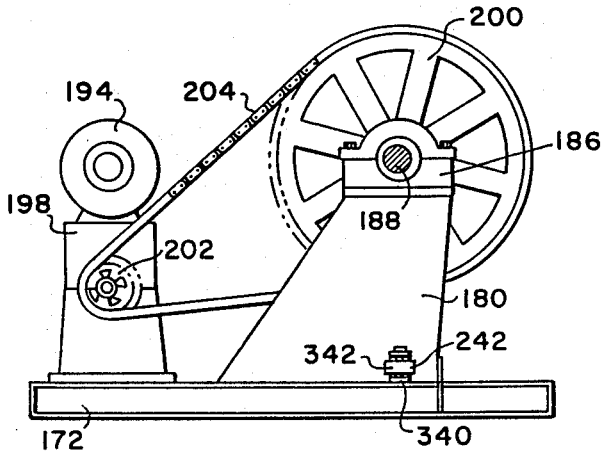
FIG. 7 is a sectional view taken along lines 7—7 of FIG. 3.

Referring now to FIG. 7, the elements for applying rotative torque to shaft 188 may be more fully appreciated. These elements include electric motor 194, gear reducer 198, driven sprocket 200, driving sprocket 202 and chain 204. Bearing 186 is a conventional pillow block bearing fixed to the top of upright member 180. End roller 242 includes a stationary portion 340 fixed to mixer support platform 172 and a rotating portion 342 disposed to contact one of the end plates 212 of the mixing drum 210. End rollers 242 thus constrain the drum 210 to limit relative longitudinal motion with respect to the shaft 188

Figure 9:
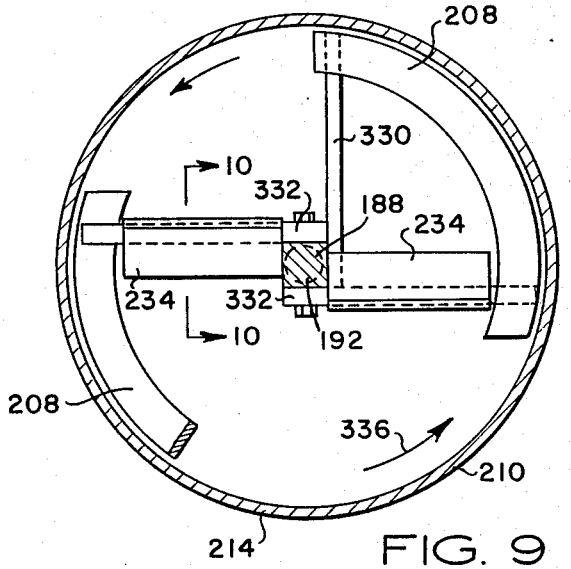
FIG. 9 is a sectional view taken along lines 9—9 of FIG. 8.
Figure 8:
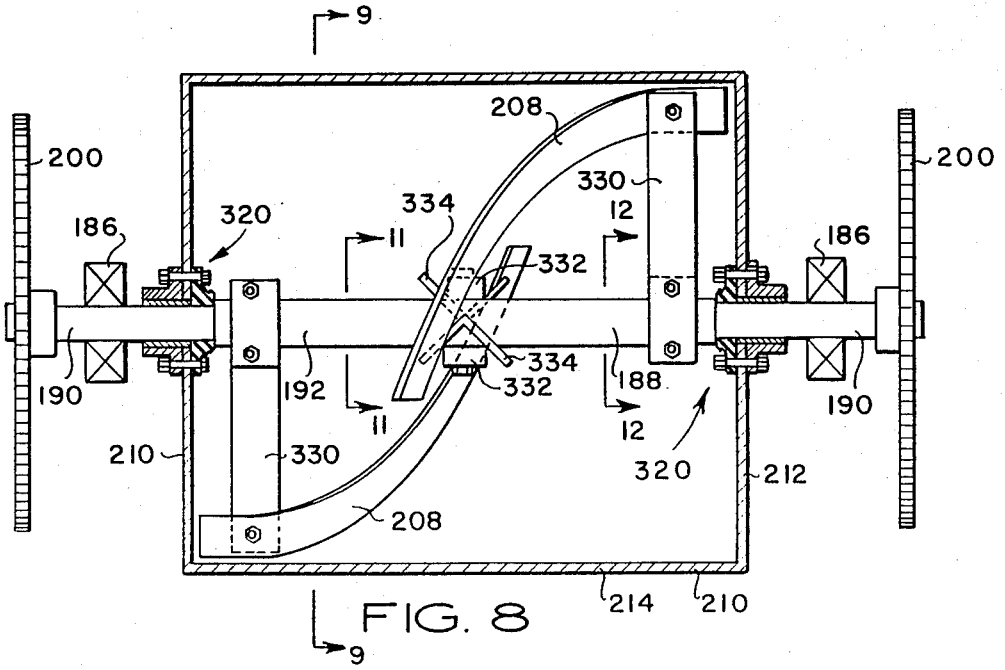
FIG. 8 is a partially broken-away view of the shaft and drum mechanisms.

Referring now to FIGS. 8 and 9, blades 208 are fixed to shaft 188 by way of outer arms 330 and central arms 332. Arms 330 and 332 are fixed to the intermediate portion 192 of shaft 188 and extend radially therefrom to terminate at their attachments to blades 208. Each of the blades 208 is a semi-spiral, being configured to push the contents of drum 210 towards the center thereof when the shaft is rotated. When mixing, the spiral blades actively mix the ingredients to provide rapid and thorough mixing. A wedge-shaped plow 334 is attached to each of the central arms 332, being pointed in the direction of shaft rotation. The intermediate portion 192 of shaft 188 has a square cross-section, while the end portions 190 of shaft 188 are circular in cross-section where they pass through the central apertures in end plates 212. The direction of rotation is indicated by arrow 336 in FIG. 9.

Figure 10:
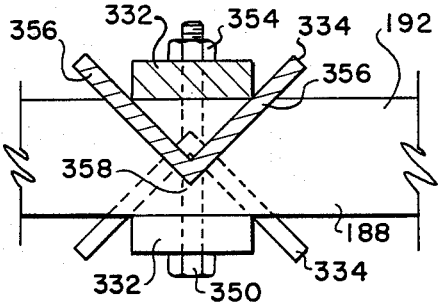
FIG. 10 is a sectional view taken along lines 10—10 of FIG. 9.
Figure 11:
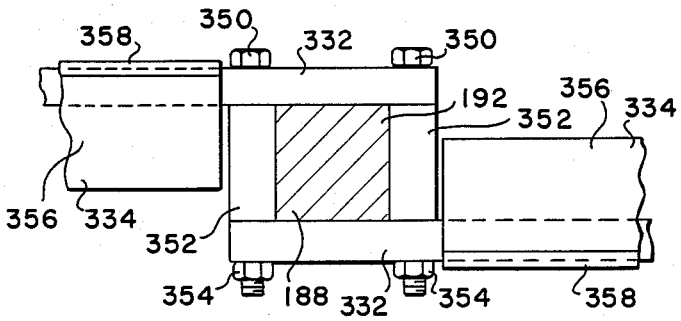
FIG. 11 is a sectional view taken along lines 11—11 of FIG. 8.

Referring now to FIGS. 10 and 11, the central arms 332 are fixed to intermediate portion 192 of shaft 188 by way of bolts 350 passing through aligned apertures and arms 322 and spacers 352. Suitable nuts 354 retain the arms 322 and spacers 352 to the intermediate 192 of the shaft 188, which is of a square cross-section to engage the square opening defined by arms 332 and spacers 352. Each of the wedge-shaped plows 334 is formed of two planar strips 356 joined along side edges at point 358 to form a wedge structure pointed in the direction of shaft rotation. Plows 334, a key feature of the invention, prevent build-up of concrete on central arms 332 when the mixer is in use.

Figure 12:
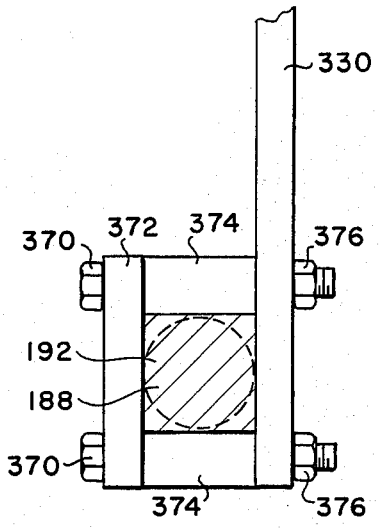
FIG. 12 is a sectional view taken along lines 12—12 of FIG. 8.

Referring now to FIG. 12, each of the outer arms 330 is fixed to the intermediate portion 192 of shaft 188 by way of bolts 370 passing through aligned apertures in cap plate 372, spacers 374 and arm 330. Suitable nuts 376 are provided to rigidly connect the arms 330 to the square cross-sectioned intermediate portion 192 for allowing corotation of arms 330 with shaft 188.

Figure 13:
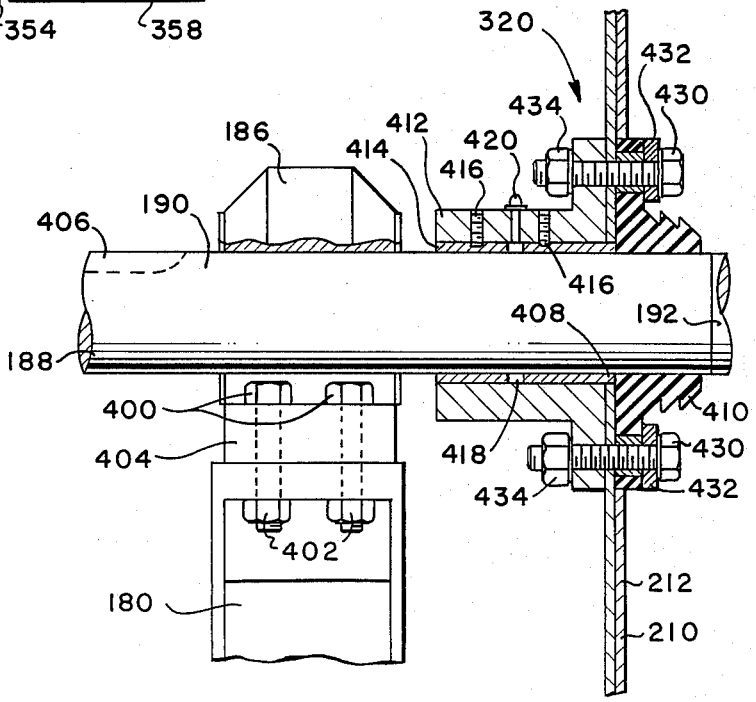
FIG. 13 is a partially broken-away detail view of the shaft bearing and seal structure.

Referring now to FIG. 13, bearings 186 are fixed to the tops of upright members 180 by way of bolts 400 and nuts 402 extending through a boss 404 at the top of each upright member 180. End portion 190 of shaft 188 includes a keyway 406 for engagement with the driven sprocket 200 (not shown). The central apertures 408 in end walls 212 are sealed by an internal resilient seal 410 encircling the shaft immediately adjacent the transition in shaft 188 from the square cross-sectioned intermediate portion 192 and the circular cross-sectioned end portion 190. A collar 412 extends outwardly from each end wall 212 and surrounds a portion of end portion 190 of shaft 18 immediately exterior central aperture 408. A bushing 414 is provided between collar 412 and end portion 190 of shaft 188, being fitted to the collar 412 by way of set screws 416. The bushing 414 includes a grease slot 418 in communication with grease fitting 420. Bushing 414 carries relatively little load, as drum 210 is substantially entirely supported by the casters 240 (FIGS. 6 and 6B) and not by collars 412 and bushings 414. Thus, the primary function of bushings 414 is to maintain coaxial alignment of drum 212 with shaft 188. Collars 412 and seals 410 are fixed for corotation with drum 210 by way of bolts 430 extending through aligned apertures in seals 410, end walls 212, and collars 412. A washer 432 is provided under the head of each bolt 430 for contact with the resilient seal 410, and suitable nuts 434 are engaged with the ends of bolts 430.

Figure 14:
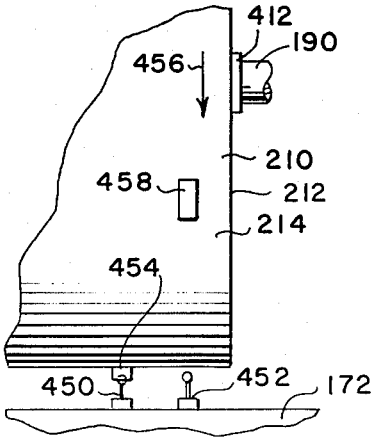
FIG. 14 is a partially broken-away view showing position limit switches for controlling the rotation of the drum.

Referring now to FIG. 14, the electrical control of the rotation of drum 210 is provided by way of limit switches 450 and 452. In a first position, a cam 454 triggers limit switch 450 to signal that the drum has reached the first position, which may, for example, be the loading position. The drum rotates in the direction of arrow 456 to obtain the second position, which may, for example, be the discharge position. A second cam 458 is provided to engage limit switch 452 when drum 210 attains the second position. Through appropriate control circuitry, the limit switches thus activate and deactivate hydraulic assemblies 230 into extension or retraction modes to rotate the drum 210 as required.

In operation, the batching plant is automated to load mixing drum 210 with concrete ingredients when the drum is in the position shown in FIG. 6A. The ingredients are introduced into the drum through opening 218. The ingredients are then agitated by way of rotation of shaft 188 and attached mixing blades 208. Unlike prior art mixers, where the drum rotates and mixing is accomplished by gravity, the mixing action of the relatively rapidly rotating mixer blades 208 is positive and quick. Typically, an entire batch of concrete can be mixed by rotating shaft 188 for approximately 30 to 50 seconds. Once the mixing time has elapsed, the hydraulic power unit is activated to retract hydraulic assemblies 230 and rotate the drum to the position shown in FIG. 6B. As shown in FIG. 6B, opening 222 is then at a horizontal elevation below the horizontal axis of the mixing drum. Rotation of shaft 188 is not interrupted during the rotation of the drum to the discharge position, such that concrete urged to the center of the drum is rapidly discharged as the drum reaches its discharge position. In the preferred embodiment, hydraulic assemblies are activated in a retraction mode for seven seconds, at the end of which the drum is in the position shown in FIG. 6B and then immediately reversed into the extension mode for another seven seconds to reattain the position shown in FIG. 6A. Thus, a total of 14 seconds is required to discharge the drum and return it to the loading position. The spiral blade and horizontal shaft mixing action enables the use of the mixer with low or zero-slump concrete. Very substantial time advantages are accomplished when the mixer of the present invention is combined with a central mix batching plant. The preferred embodiment of the mixer has a capacity of four and one-half yards of concrete. When used with a batching plant having a forty-eight-inch conveyor belt, the batching plant and mixer can mix 200 yards of concrete per hour with a fifty-second mix time and a seven-second discharge time. This output capacity enables the production of a prior art ten-yard mixer with a mixer of less than half the size (four and one-half yards).

Whereas the present invention has been described with respect to a specific embodiment thereof, it will be understood that various changes and modifications will be suggested to one skilled in the art and it is intended to encompass such changes and modifications as fall within the scope of the appended claims.

What is claimed is:

1. A mixing apparatus, comprising:

a horizontal mixer support platform;

two spaced shaft supports extending upwardly from the mixer support platform;

a bearing fixed to each shaft support at a location spaced above the mixer support platform;

a shaft extending between the bearings and being supported thereby for rotation about a horizontal axis;

a plurality of arms fixed to the shaft and extending radially therefrom for corotation with the shaft;

mixing blades fixed to the arms;

power means for causing controlled rotation of the shaft, arms and blades;

a mixing drum defined by two disk-shaped end plates and a substantially tubular intermediate member between the end plates and having exterior and interior walls being cylindrical about a central axis;

the shaft extending through central apertures in the end plates such that the mixing drum central axis is coaxial with the shaft;

the arms and blades and an intermediate portion of the shaft being enclosed by the interior walls of the mixing drum;

the bearings being exterior to the mixing drum;

the mixing drum being rotatable about its central axis between a first position for loading the mixing drum and a second position for discharging the mixing drum; and the mixing drum being supported by drum support means for supporting the mixing drum, the drum support means being fixed to the mixer support platform, such that the mixing drum is substantially entirely supported by the drum support means, with the shaft, arms and mixing blades being substantially entirely supported by the shaft supports.

2. The apparatus of claim 1 wherein the drum support means include a plurality of casters having stationary portions fixed to the mixer support platform and extending upwards to rotatable portions, the rotatable portions having exterior cylindrical surfaces in contact with the mixing drum intermediate member.

3. The apparatus of claim 1 having drum side control means for maintaining the longitudinal relationship between the mixing drum and the shaft.

4. The apparatus of claim 3 wherein the drum side control means includes a drum side roller at each end of the mixing drum having a stationary position fixed to the mixer support platform and having a rotating portion in contact with one of the end plates of the mixing drum, such that the mixing drum is constrained to limit relative longitudinal motion with respect to the shaft.

5. A mixing apparatus, comprising:

a horizontal mixer support platform;

two spaced shaft supports extending upwardly from the mixer support platform;

a bearing fixed to each shaft support at a location spaced above the mixer support platform;

a shaft extending between the bearings and being supported thereby for rotation about a horizontal axis;

a plurality of arms fixed to the shaft and extending radially therefrom for corotation with the shaft;

mixing blades fixed to the arms;

power means for causing controlled rotation of the shaft, arms, and blades;

a mixing drum defined by two substantially disk-shaped end plates and a substantially tubular intermediate member between the end plates and having exterior and interior walls being cylindrical about a central axis;

the shaft extending through central apertures in the end plates such that the mixing drum central axis is coaxial with the shaft;

the arms and blades and an intermediate portion of the shaft being enclosed by the interior walls of the mixing drum;

the bearings being exterior to the mixing drum;

the mixing drum being rotatable about its central axis between a first position for loading the mixing drum and a second position for discharging the mixing drum;

wedge-shaped plows attached to at least some of the arms extending from the shaft, the plows being pointed in the direction of shaft rotation during mixing to prevent build-up of material on the arms; and the plows being formed of two planar strips each having a rectangular cross-section in a plane perpendicular to an arm and being permanently attached to at least some of the arms, longitudinal with the arms, and joined along side edges to form a wedge structure pointed in the direction of shaft rotation.

6. A portable concrete mixer for use in connection with a portable concrete batching plant, comprising:

a semi-trailer formed from a framework and having at least one support axle, a rear portion of the framework defining a rear equipment platform suspended above the axle;

a medial portion of the framework adjoining the rear portion of the framework and defining a medial equipment platform;

a front portion of the framework defining a tongue adjoining the medial portion of the framework opposite the rear portion of the framework;

leveling supports disposed beneath the medial portion of the framework for levelably supporting the semi-trailer when disconnected from a tow vehicle;

a hydraulic power unit disposed on the rear equipment platform for providing a hydraulic fluid under pressure;

a mixer support framework attached to and extending upwardly from the medial equipment platform to define a mixer support platform above the medial equipment platform;

a mixer cradle formed by a pair of spaced upright members extending upwardly from front and rear sides of the mixer support platform, the front and rear sides of the mixer support platform being substantially immediately above the adjoining areas of the front and medial portions of the framework, and rear and medial portions of the framework, respectively;

each of the pair of upright members including a bearing at the upper end thereof being fixed in coaxial alignment with the other bearing;

a shaft supported by the bearings for rotation about an axis horizontal and substantially longitudinal with respect to the semi-trailer;

the shaft having end portions extending outwardly from the bearings and an intermediate portion extending between the bearings;

torque means for applying rotative torque to at least one of the ends of the shaft, said torque means being fixed to the mixer support framework and being coupled to said at least one end of the shaft;

arms extending radially from the intermediate portion of the shaft;

mixer blades fixed to the outer extremities of the arms for corotation with the shaft, said blades describing an envelope that is approximately cylindrical;

the weight of the shaft, arms and blades being substantially entirely supported by the bearings;

a mixer drum formed by two disk-shaped end walls and a tubular side wall, said walls forming a substantially cylindrical outer surface and a substantially cylindrical inner surface, with the inner surface being in close proximity to the envelope described by the mixing blades;

the end walls of the mixer drum having central apertures encircling the shaft such that the arms, mixer blades and substantially all of the intermediate portion of the shaft are enclosed by the drum;

the tubular side wall of the mixer drum having a first opening formed therein for loading the mixer drum and a second opening therein for discharging the mixer drum;

seal means for sealing the circular apertures in the end walls about the shaft;

drum support means for rotatably supporting the mixer drum on the mixer support platform, with the weight of the drum being substantially entirely supported by the drum support means;

drum side control means for axially restraining the mixer drum with respect to the shaft;

at least one hydraulic piston and cylinder assembly extending between the mixer drum and the mixer support framework, the assembly being attached to the mixer drum at a point radially spaced from the axis of the shaft; and the piston and cylinder assembly being connected to the hydraulic power unit for extending and retracting the assembly, thereby rotating the mixer drum from a mixing position to a discharge position when retracting and from a discharge position to a mixing position when extending, the first opening being disposed for receiving materials to be mixed when the mixer drum is in the mixing position, and the second opening being disposed for discharging materials after mixing when the mixer drum is in the discharge position.

7. A mixing apparatus, comprising:

a horizontal mixer support platform;

two spaced shaft supports extending upwardly from the mixer support platform;

a bearing fixed to each shaft support at a location spaced above the mixer support platform;

a shaft extending between the bearings and being supported thereby for rotation about a horizontal axis;

a plurality of arms fixed to the shaft and extending radially therefrom for corotation with the shaft;

mixing blades fixed to the arms;

power means for causing controlled rotation of the shaft, arms, and blades;

a mixing drum defined by two substantially disk-shaped end plates and a substantially tubular intermediate member between the end plates and having exterior and interior walls being cylindrical about a central axis;

the shaft extending through central apertures in the end plates such that the mixing drum central axis is coaxial with the shaft;

the arms and blades and an intermediate portion of the shaft being enclosed by the interior walls of the mixing drum;

the bearings being exterior to the mixing drum;

the mixing drum being rotatable about its central axis between a first position for loading the mixing drum and a second position for discharging the mixing drum; and the mixing drum being supported by drum support means for supporting the mixing drum, the drum support means being fixed to the mixer support platform, such that the mixing drum is substantially entirely supported by the drum support means, with the shaft, arms and mixing blades being substantially entirely supported by the shaft supports.

* * * * *